US005524151A

United States Patent [19]

Bleim

[11] Patent Number: 5,524,151

[45] **Date of Patent: * Jun. 4, 1996**

[54] ELECTROACOUSTIC TRANSDUCER HAVING A MASK

[75] Inventor: Peter Bleim, Vienna, Austria

[73] Assignee: U.S. Philips Corporation, New York, N.Y.

[ * ] Notice: The term of this patent shall not extend beyond the expiration date of Pat. No. 5,303,209.

[21] Appl. No.: 422,666

[22] Filed: Apr. 10, 1995

Related U.S. Application Data

[63] Continuation of Ser. No. 163,490, Dec. 7, 1993, abandoned.

[30] Foreign Application Priority Data

Feb. 26, 1993 [AT] Austria ..... 367/93

[51] Int. Cl.[6] ..... H04R 25/00

[52] U.S. Cl. ..... 381/192; 381/201; 381/159

[58] Field of Search ..... 381/199, 188, 381/205, 192, 90, 159; 181/160; 367/174

[56] References Cited

U.S. PATENT DOCUMENTS

| | | | |
|---|---|---|---|
| 2,217,177 | 10/1937 | Massa | 381/199 |
| 2,252,846 | 9/1938 | Giannini et al. | 381/199 |
| 4,027,116 | 5/1977 | Nakamura | 179/180 |
| 5,166,984 | 11/1992 | Hsiao | 381/199 |
| 5,303,209 | 4/1994 | Frasl | 381/159 |

*Primary Examiner*—Curtis Kuntz
*Assistant Examiner*—Sinh Tran
*Attorney, Agent, or Firm*—Robert J. Kraus

[57] ABSTRACT

In an electroacoustic transducer (1) having a diaphragm (5), a partition wall (24) situated behind the diaphragm (5) and traversed by partition openings (25, 26, 7, 28 and 29, 30, 31, 32), and a mask (37) arranged adjacent the partition wall and provided with mask openings (38, 39, 40, 41) which can be made to coincide with different openings (25, 26, 27, 28 and 29, 30, 31, 32, respectively) in different positions of the partition wall (24) and the mask (37) relative to one another, the mask is simply formed by a flange (37) of a magnet-system pan (19) of the magnet system (16) of the transducer (1).

8 Claims, 2 Drawing Sheets

ELECTROACOUSTIC TRANSDUCER HAVING A MASK

This is a continuation of application Ser. No. 08/163,490, filed 7 Dec. 1993 now abandoned.

BACKGROUND OF THE INVENTION

The invention relates to an electroacoustic transducer having a diaphragm constructed to be capable of vibration parallel to a transducer axis, which transducer comprises a partition wall facing the back of the diaphragm, which partition wall substantially extends transversely of the transducer axis and is traversed by at least one partition opening to form a passage between a first space situated between the diaphragm and one side of the partition wall, and a second space situated at the other side of the partition wall, and a mask arranged adjacent one of the two sides of the partition wall and having at least one mask opening traversing it to form the passage between the two spaces, which partition wall and mask can be brought into and fixed in at least two mutually rotated relative positions with respect to the transducer axis in order to obtain different acoustically active cross-sectional areas of the passage between the two spaces, which passage is formed by means of the openings in the partition wall and the mask, which openings can be made to coincide at least partly in the direction of the transducer axis, and a magnet system comprising at least one magnet-system pan.

An electroacoustic transducer of the type defined in the opening paragraph is known, for example from U.S. Pat. No. 4,027,116. In this known transducer the mask is formed by an annular disc which is slid onto the cylindrical outer surface of a potshaped part of the magnet system of the transducer and adjoins an annular partition wall of a transducer chassis for mounting the diaphragm and the magnet system, which disc can be brought into three different positions relative to the partition wall by rotating it about the pot-shaped magnet-system pan which is coaxial with the transducer axis. In the known transducer the mask constructed as an annular disc forms a separate pan, which forms an additional element to be mounted and requires additional assembly steps and costs. Moreover, the additional pan gives rise to additional tolerance effects, which adversely affect the reproducibility of the acoustic characteristics of the transducer.

SUMMARY OF THE INVENTION

It is an object of the invention to simplify the construction of a transducer of the type defined in the opening paragraph in order to reduce the productions costs, which is important particularly in the case of mass production of such a transducer, and to improve it in order to eliminate undesired effects of tolerances on the reproducibility of the acoustic characteristics of the transducer. To this end the invention is characterized in that the magnet-system part of the magnet system has a flange which substantially extends transversely of the transducer axis, and the flange of the magnetsystem part forms the mask of the transducer, which mask has at least one mask opening. In this way it is achieved that the mask of a transducer in accordance with the invention is not formed by a separate part but by a portion of a transducer part which is present anyway, which has the advantage that parts costs are reduced and, in particular, that the number of assembly steps and the assembly costs are minimized. These advantages are of great significance particularly in the case of mass production because this enables a simpler assembly line to be used. Moreover, since the mask of a transducer in accordance with the invention is formed by a portion of a transducer pan no additional tolerance effects are introduced by the mask, which is favourable for a good reproducibility of the acoustic characteristics of the transducer.

It is possible, for example, to provide the partition wall and the mask each with two openings of circular cross-section and comparatively large diameter and to bring the partition wall and the mask into such positions relative to one another that in each relative position the two openings form a passage between the two spaces which has a double convex active cross-sectional area, which area and hence the acoustic inductance and friction differ depending on the relative position and, consequently, result in different frequency response characteristics of the transducer, but the active cross-sectional areas and hence the frequency response characteristics then depend comparatively strongly on positional tolerances between the partition wall and the mask. It has proved to be advantageous if the partition wall has at least two partition openings of different cross-sectional area, and in one relative position a mask opening formed in the mask coincides with a partition opening to form a passage between the two spaces and in the other relative position coincides with the other partition opening to form another passage between the two spaces. This results in a particularly simple and accurately defined variation of the frequency response of such a transducer, which is substantially independent of positional tolerances, because depending on the relative position of the partition wall and the mask the acoustically active cross-sectional areas of the passages connecting the two spaces and forming the acoustic inductances and resistances are accurately defined by the cross-sectional areas of the openings.

It has also proved to be advantageous if the mask has at least two mask openings of different cross-sectional area, and in one relative position a partition opening formed in the partition coincides with a mask opening to form a passage between the two spaces and in the other relative position coincides with the other mask opening to form another passage between the two spaces. This results in a particularly simple and accurately defined variation of the frequency response of such a transducer, which is substantially independent of positional tolerances, in which the acoustically active cross-sectional areas of the passages connecting the two spaces and forming the acoustic inductances and resistances are accurately defined by the cross-sectional areas of the openings.

It has also proved to be very advantageous if of the openings of different cross-sectional area each opening having a small cross-sectional area is of circular cross-section, and the diameter of each such opening of circular cross-section is smaller than 0.3 mm in its acoustically active cross-sectional area. Such openings or holes of small diameter can be made very accurately with given dimensions with very small tolerances, so that such openings provide accurately defined acoustic inductance values and resistance values, which are determined by the ratio between the acoustically active cross-sectional area and length of the opening, so that the passages formed by means of the openings and connecting the two transducer spaces have accurately defined influences on the acoustic characteristics of the transducer.

It has also proved to be particularly advantageous if the diameter of each such opening of circular cross-section is 0.2 mm in its acoustically active cross-sectional area. Tests have revealed that such a construction provides very good results.

It has also proved to be particularly advantageous if each such opening of circular cross-section has a conical shape in its axial direction. This is advantageous for an accurately defined acoustically active cross-sectional area of such an opening, concentrated at the area of smallest diameter of the opening. It is also advantageous when such an opening is to be made in a plastics part in view of easy demoulding.

BRIEF DESCRIPTION OF THE DRAWING

The invention will now be described in more detail with reference to the drawing, which shows three exemplary embodiments to which the invention is not limited.

DESCRIPTION OF THE PREFERRED EMBODIMENTS

Figure 1:
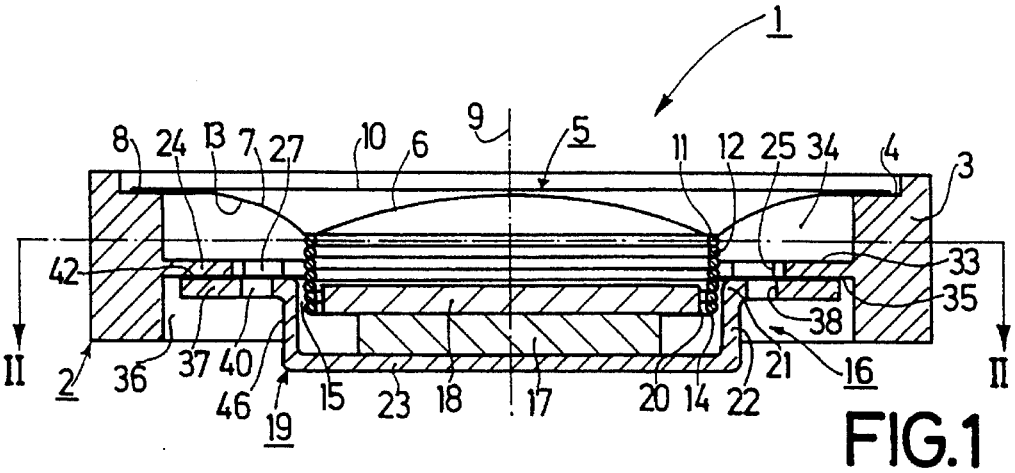
FIG. 1 is a slightly diagrammatical cross-sectional view, taken on the line I—I in FIG. 2 and to a larger than full-size scale, showing an electrodynamic transducer in a first embodiment of the invention, in which a mask of the transducer is in a first position relative to a partition of the transducer.
Figure 2:
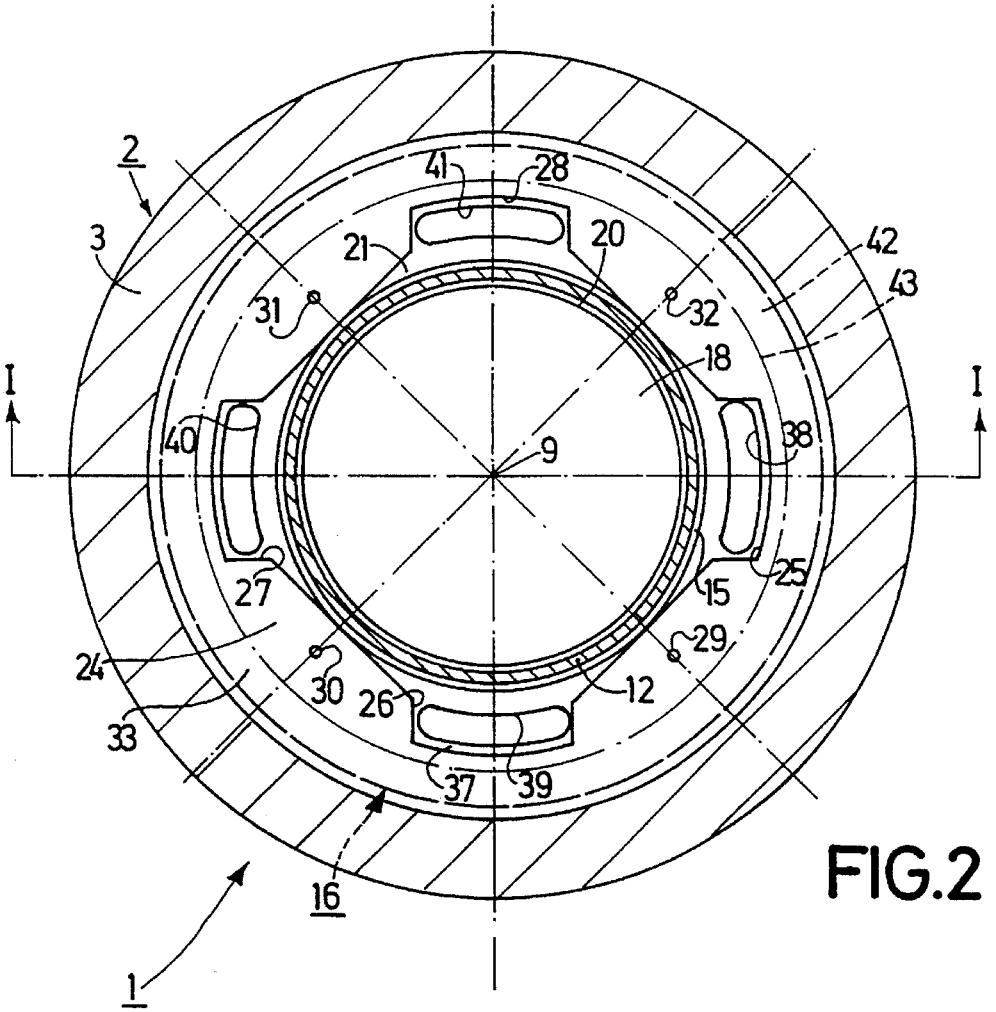
FIG. 2 shows the transducer in a sectional view taken on the line II—II in FIG. 1.

FIGS. 1 and 2 show an electrodynamic transducer 1 in a first embodiment of the invention, constructed as a loudspeaker. The transducer 1 has an essentially annular or hollow cylindrical mounting device 2. The mounting device 2 has an annular outer wall 3 having a stepped portion 4 in its area facing a front side of the transducer 1. The stepped portion 4 forms a mounting zone to which a diaphragm 5 of the transducer 1 is secured by an adhesive joint. The diaphragm 5 has a central portion 6, which is often referred to as a dome. The diaphragm 5 further has a peripheral portion 7 provided with hyperbolic corrugations, not shown in FIG. 1. With the outer edge 8 of the peripheral portion 7 the diaphragm 5 is connected to the stepped portion 4 of the mounting device 2 by an adhesive. The diaphragm 5 is constructed to allow back and forth vibration parallel to a transducer axis 9 and from its front side 10 it emits useful waves which are audible in operation.

In the transitional area 11 between the central portion 6 and the peripheral portion 7 of the diaphragm 5 a moving coil 12 is connected to the diaphragm 5 by an adhesive joint. In the present case the moving coil 12 projects into an air gap 15 of a magnet system 16 of the transducer 1 with its part 14 which is remote from the back 13 of the diaphragm. The magnet system 16 comprises a magnet 17, a pole plate 18, and a pot 19, often referred to as an outer pot. The air gap 15, in which the part 14 of the moving coil 12 is disposed, is situated between the circumferential bounding surface 20 of the pole plate 18 and the periphery 21 of the hollow cylindrical portion 22, which is closed by the bottom portion 23 of the pot 19.

In the present transducer 1 the mounting device 2 comprises a substantially annular partition wall 24, which projects radially inward from the outer wall 3 and which faces the back 13 of the diaphragm 5 and extends transversely of the transducer axis 9. The partition wall 24 has four partition openings 25, 26, 27, 28 and 29 of substantially slot-shaped cross-sectional area, which traverse the partition wall 24 and which are equispaced at angles of 90° from one another. The partition wall 24 further has four partition openings 29, 30, 31 and 32 of circular cross-sectional area, which also traverse the partition wall 24 and which are equispaced at angles of 90° from one another and spaced at angles of 45° from the respective slot-shaped partition openings 25, 26, 27 and 28. The partition openings 25, 26, 27, 28 and 29, 30, 31, 32 serve to form passages between a space 34 situated between the diaphragm 5 and one side 33 of the partition wall 24 and a space 36 at the other side 35 of the partition wall 24. In the electrodynamic transducer 1 constructed as a loudspeaker, as shown in FIGS. 1 and 2, the space 36 is open towards the back of the transducer 1. The slot-shaped partition openings 25, 26, 27 and 28 may have a length of, for example, approximately 6 mm. It is found to be advantageous if the circular partition openings 29, 30, 31 and 32 have a diameter smaller than 0.3 mm and preferably 0.2 mm. However, alternatively the circular partition openings may have a diameter of, for example, only 50 or 40 μm. In the present transducer 1 shown in FIGS. 1 and 2 the circular partition openings 29, 30, 31 and 32 axe cylindrical in their axial directions.

The transducer 1 further comprises a mask 37 disposed adjacent the side 5 of the partition wall 24 and in the present case adjoining the partition wall 24. The mask 37 has four mask openings 38, 39, 40, and 41 of slot-shaped cross-sectional area, which traverse the mask 37 and which are equispaced at angles of 90° from one another to form the passages between the two spaces 34 and 36. The slot-shaped openings 38, 9, 40, and 41 may have a length of approximately 5 mm and a width of approximately 2.2 mm.

In order to obtain different acoustically active cross-sectional areas of the passages between the two spaces 34 and 36, which passages are formed by the openings 5, 26, 27, 28 and 29, 30, 31, 32 in the partition wall 24 and 38, 39, 40, 41 in the mask 37, which openings can be made to coincide in the direction of the transducer axis 9, the partition wall 24 and the mask 37 can be brought into and fixed in two mutually rotated positions relative to the transducer axis 9. In the transducer 1 in the form of a loudspeaker, as shown in FIGS. 1 and 2, the partition wall 24 and the mask 37 have been brought into and fixed in such a position relative to one another that the partition openings 25, 26, 27 and 28 coincide with the mask openings 38, 39, 40, and 41. At the location of two coincident openings this results in a very large acoustically active cross-sectional area of the respective passage between the two spaces 34 and 36, which is defined exactly by the cross-sectional area of the mask openings 38, 39, 40 and 41 and which is required in order to realize a transducer in the form of a loudspeaker and the desired frequency response for such a loudspeaker.

As can be seen in FIGS. 1 and 2, the pot 19 of the magnet system 16 in the transducer 1 has a flange 37 which extends transversely of the transducer axis 9 and by which the pot 19 is glued to the partition wall 24, in order to secure the entire magnet system 16, along a continuous substantially circular adhesive joint 43, which is situated in the outer area of the flange 37 and whose inner boundary 43 is represented diagrammatically as a dash-dot line in FIG. 2. It is obvious that in practice such an adhesive joint 42 does not have such an exactly circular boundary 43.

The flange 37 of the pot 19 of the magnet system 16 constitutes not only a fixing element for securing the magnet system 16 to the mounting device 2 but, in a very simple and very advantageous manner, also the mask 37 of the transducer 1. Thus, it is achieved that the mask 37 of the transducer 1 is not formed by a separate part but by a portion of a part of the transducer 1 which is present anyway, i.e. by the flange 37 of the pot 19 of the magnet system 16 of the transducer 1. This has the advantage that parts costs are reduced and, in particular, that the number of assembly steps and the assembly costs are minimized. A minimal number of assembly steps and minimal assembly costs are of great significance for the mass production of such an electrodynamic transducer 1 because this enables a simpler assembly line to be used. Moreover, no additional tolerance effects are introduced by constructing the flange of the pot as a mask, which is favourable for a good reproducibility of the acoustic characteristics of the transducer 1.

Figure 3:
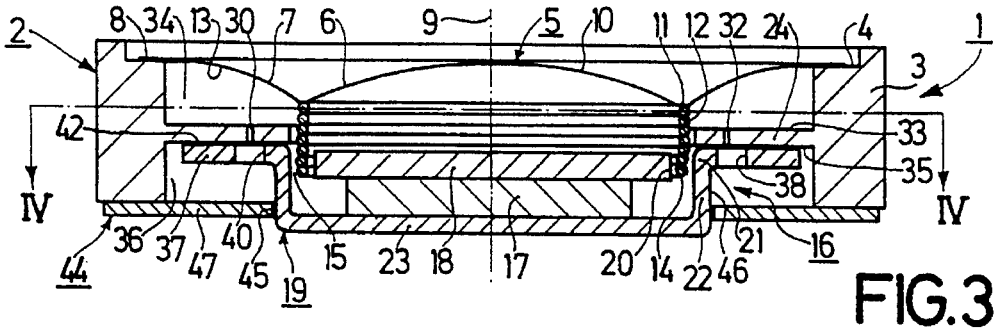
FIG. 3 is a sectional view similar to that in FIG. 1 but taken on the line III—III in FIG. 4 and showing an electrodynamic transducer in a second embodiment of the invention of essentially the same construction as the transducer shown in FIG. 1 but in which the transducer mask is in a second position relative to the transducer partition.
Figure 4:
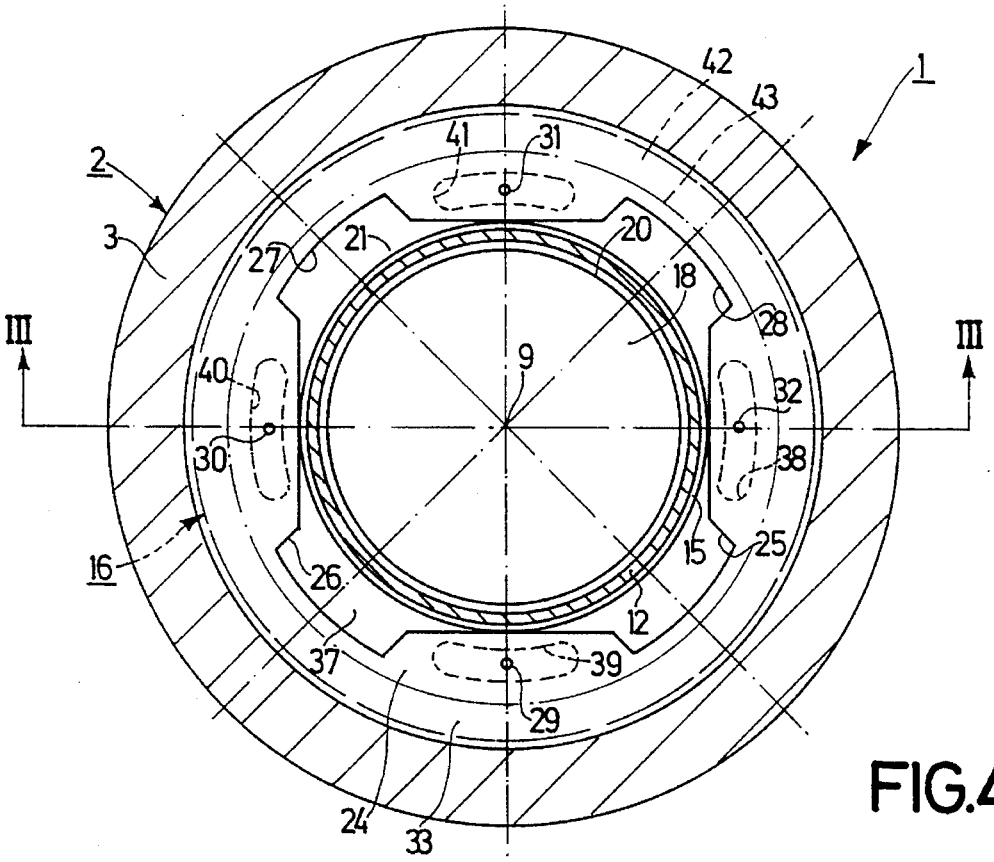
FIG. 4 shows the transducer of FIG. 3 in a sectional view taken on the line IV—IV in FIG. 3.

FIGS. 3 and 4 show an electrodynamic transducer 1 in a second embodiment of the invention, constructed as a receiver or microphone capsule for telecommunication purposes, particularly telephony purposes. The transducer 1 shown in FIGS. 3 and 4 is of essentially the same construction as the transducer 1 shown in FIGS. 1 and 2. However, in contradistinction to the transducer shown in FIGS. 1 and 2, the space 36 at the other side 35 of the partition wall 24 is closed in the transducer 1 shown in FIGS. 3 and 4.

There is provided a plate-shaped closing member 44 for closing the space 36. The closing member 44 has an opening 45, in the present case of circular cross-section, by which the closing member 44 is mounted on the outer circumferential surface 46 of the pot 19 of the magnet system 16 with an acoustically sealed fit. The closing member 44 has a peripheral portion 47 surrounding the opening 45, by which the closing member 44 is connected to the outer wall 3 of the mounting device 2 in an acoustically sealed and mechanically rigid manner. The mounting device 2, i.e. its outer wall 3, thus constitutes a pan bounding the second space 36 in the present transducer 1. The mounting device 2 and the closing member 44 are made of the same synthetic material and are mechanically secured to one another by ultrasonic welding. At the location of the opening 45 the closing member 44 is connected very simply to the outer circumferential surface 46 of the pot 19 of the magnet system 16 only by means of a mechanical press fit.

In the transducer 1 shown in FIGS. 3 and 4 the partition wall 24 and the mask 37 can also be brought into and held in another position relative to each other than shown in FIGS. 1 and 2. In the transducer 1 shown in FIGS. 3 and 4 the partition wall 24 and the mask 37, i.e. the flange 37 of the pot 19 of the magnet system 16, can be brought into and held in a position relative to one another in which the circular partition openings 29, 30, 31 and 32 coincide with the slot-shaped mask openings 38, 39, 40, and 41. At the location of two coincident openings this results in a very small acoustically active cross-sectional area of the relevant passage between the two spaces 34 and 36, which passage is defined exactly by the cross-sectional area of the circular partition openings 29, 30, 31 and 32 and which is required in order to realize a transducer constructed as a receiver or microphone capsule and the desired frequency response for such a capsule.

In the transducer 1 shown in FIGS. 3 and 4, which apart from the closing member 44 consists of the same pans as the transducer 1 shown in FIGS. 1 and 2, the mask 37 of the transducer 1 is also formed by a portion of a part of such a transducer, which as already stated, has the advantage of lower parts costs and, in particular, a minimal number of assembly steps and minimal assembly costs and a good reproducibility of the acoustic characteristics of such a transducer.

Figure 5:
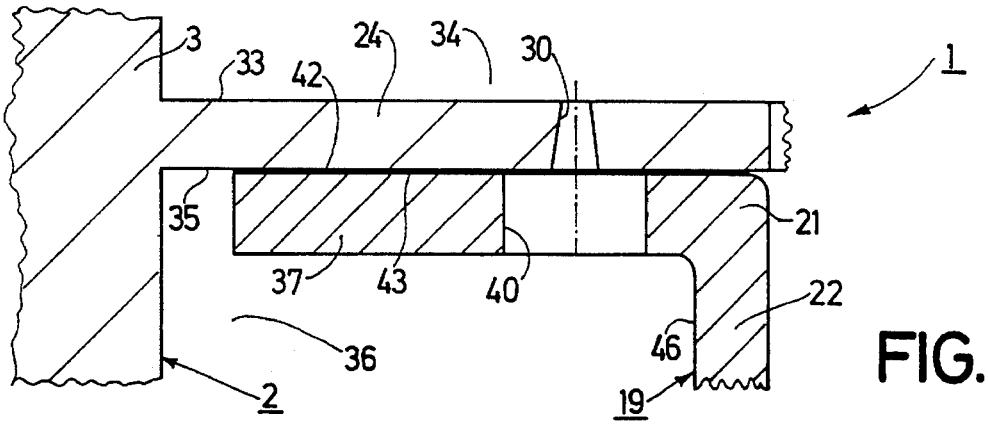
FIG. 5 is a cross-sectional view to a larger scale than FIGS. 1 and 3, showing a part of an electrodynamic transducer in a third embodiment of the invention of essentially the same construction as the transducer shown in FIGS. 3 and 4 but having conical partition openings in its partition wall.

FIG. 5 shows a part of an electrodynamic transducer 1 in a third embodiment of the invention, which similarly to the transducer 1 shown in FIGS. 3 and 4 is constructed as a receiver or microphone capsule for telecommunication purposes. In the transducer 1 shown in FIG. 5 each opening 29, 30, 31 and 32 of circular cross-section, of which only the opening 30 is shown in FIG. 5, is conical viewed in its axial direction. This is advantageous for an accurately defined acoustically active cross-sectional area of such an opening, concentrated at the area of smallest diameter of the opening, i.e. in the case of the transducer 1 shown in FIG. 5 at the end portions of the openings 29, 30, 31 and 32 which are remote from the mask 37.

The invention is not limited to the three exemplary embodiments of the transducer described hereinbefore. For example, the flange of the pot of a pot-core magnet system as used in the three transducers described herein, which flange serves as a mask, may also adjoin a partition wall of such a mounting device at the side facing the diaphragm. In a transducer in accordance with the invention it is also possible to use another magnet system than a pot-core magnet system, for example a ring-core magnet system. Moreover, the partition wall may have, for example, more than two different types of partition openings, which can be made to coincide with, for example, more than one type of mask openings in a mask formed by a flange in different positions of the partition wall and the mask relative to one another. Instead of providing only one opening of circular cross-section of small diameter in a part of the partition wall it is also possible to provide two or more of such openings of circular cross-section of even smaller diameter.

I claim:

1. An electroacoustic transducer comprising:

a. a diaphragm having movable front and rear sides arranged for vibrating along an axis;

b. electromagnetic means coupled to the diaphragm;

c. a partition member separating first and second spaces, said first space being disposed between the rear side of the diaphragm and a first side of the partition member and said second space being disposed on a second side of the partition member;

d. a mask member having a first side rotatably disposed adjacent one of the first and second sides of the partition member and having a second side facing one of the first and second spaces;

the partition member and the mask member including openings which are located and dimensioned such that, by relative rotation of said members, a first opening in the one member can be brought into communication either:

(1) with a first opening in the other member to form a first passageway between the first and second spaces, said first passageway having a first cross-sectional area, or (2) with a second opening in the other member to form a second passageway between said spaces, said second passageway having a second cross-sectional area which is different from any cross-sectional area obtainable with the first opening in said other.

2. An electroacoustic transducer as in claim 1 where the first side of the mask member is adjacent the second side of the partition member.

3. An electroacoustic transducer as in claim 1 where the second opening is in the partition member.

4. An electroacoustic transducer as in claim 1 where the second opening is circular and has a diameter which is smaller than 0.3 mm.

5. An electroacoustic transducer as in claim 4 where the diameter is approximately 0.2 mm.

6. An electroacoustic transducer as in claim 1 including a housing for the electromagnetic means, said housing having a flange comprising the mask member.

7. An electroacoustic transducer as in claim 1 where the second opening in the other member has a conical shape.

8. An electromagnetic transducer as in claim 1 where the first opening in said other member is much smaller than the first opening in said one member and where said second opening in said other member is at least as large as said first opening in said one member.

* * * * *